United States Patent [19]

Nelson et al.

[11] Patent Number: 5,036,671

[45] Date of Patent: Aug. 6, 1991

[54] METHOD OF LIQUEFYING NATURAL GAS

[75] Inventors: Warren L. Nelson, Orinda; Luc Garcia, San Francisco, both of Calif.

[73] Assignee: Liquid Air Engineering Company, Montreal, Canada

[21] Appl. No.: 475,908

[22] Filed: Feb. 6, 1990

[51] Int. Cl.[5] ..... F25J 3/06

[52] U.S. Cl. ..... 62/23; 62/48.2

[58] Field of Search ..... 62/11, 38, 39, 23, 48.2

[56] References Cited

U.S. PATENT DOCUMENTS

| | | | |
|---|---|---|---|
| 3,616,652 | 11/1971 | Engel | 62/11 |
| 4,638,639 | 1/1987 | Marshall et al. | 62/38 |
| 4,740,223 | 4/1988 | Gates | 62/38 |
| 4,758,257 | 7/1988 | Gates | 62/38 |

*Primary Examiner*—Ronald C. Capossela

*Attorney, Agent, or Firm*—Oblon, Spivak, McClelland, Maier & Neustadt

[57] ABSTRACT

A method of producing a methane-rich liquid stream from a stream of natural gas predominantly consisting of methane and also containing nitrogen, entailing:

(a) supplying said natural gas stream at a pressure above atmospheric pressure, (b) cooling and liquefying said natural gas stream using one or more refrigeration cycles, and (c) expanding said liquefied natural gas to lower pressure in two or more stages in series, phase separating the gas and liquid phases produced during the expansion, thereby concentrating the nitrogen into the vapor phase, and producing a methane-rich liquefied natural gas.

25 Claims, 1 Drawing Sheet

METHOD OF LIQUEFYING NATURAL GAS

BACKGROUND OF THE INVENTION

1. Field of the Invention

The present invention relates to a method of liquefying natural gas.

2. Description of the Background

The liquefaction of natural gas has been carried out for many years for the purpose of storing the same for later use and for reducing the volume thereof so that it can be economically transported.

Various refrigeration cycles have been used to provide the refrigeration required to liquefy natural gas. One typical refrigeration cycle used is a cascade refrigeration cycle employing three individual refrigerants in series, each of which is circulated in closed cycle in heat exchange relationship with the feed stream and with each other. This type of cycle is relatively efficient but has a high capital cost due to the fact that numerous heat exchangers, compressors and interconnecting pipelines are required.

Another refrigeration cycle used for liquefaction of natural gas employs a multicomponent refrigerant fluid which is first cooled by heat exchange with cooling water or ambient air and is then totally condensed and subcooled by heat exchange with the same multicomponent refrigeration stream after it has been expanded to low pressure. At any given temperature of the low pressure multicomponent refrigeration stream excess refrigeration is produced which is used to liquefy the natural gas. Many variations of this type of refrigeration cycle have been used such as using one or more partial condensations, separating the liquid from the gas after each partial condensation and remixing the condensed fractions at low pressure to reconstitute the original stream. In another variation, the multicomponent refrigerant stream is first cooled and partially condensed by a single component refrigerant stream circulating in a closed cycle.

Some of the variations of refrigeration cycles which have been used may be found, for example, in U.S. Pat. Nos. 3,020,723, 3,645,106, 3,763,658, and 4,065,278.

U.S. Pat. No. 3,020,723 describes a liquefaction method and apparatus wherein the refrigeration cycle is partitioned into separate stages whereby use is made of separate refrigerants in areas where the refrigerants are most effective as a heat exchange medium.

U.S Pat. No. 3,645,106 discloses a closed cycle refrigerant, wherein the multicomponent refrigerant is compressed and then successively fractionated by partial condensation in a plurality of steps to provide condensates at progressively decreasing temperature levels. The condensates are separated and introduced under reduced pressure into a common zone in heat exchange with the natural gas and vaporization of the condensates. The multicomponent refrigerant is withdrawn from the zone for recycle.

U.S. Pat. No. 3,763,658 pertains to a refrigeration system wherein a feed stream is first subjected to heat exchange with a single component refrigerant in a closed, cascade cycle. Then, the feed stream is subjected to heat exchange with a multicomponent refrigerant in a multiple zone heat exchange forming a portion of a second, closed refrigerant cycle.

Finally, U.S. Pat. No. 4,065,278 describes a liquefaction process in which feedstock is isentropically expanded and distilled at a pressure lower than the critical pressure to form an overhead rich in methane and a bottom fraction. In this method, the methane rich overhead is compressed utilizing the energy obtained from the expansion and then the compressed overhead is liquefied in a refrigeration cycle.

The advantage of the multicomponent refrigeration cycles is a low capital cost due to the few pieces of equipment that are required. On the other hand, the power required is higher than for a pure component cascade cycle.

Natural gas is predominately methane but also contains many other components such as ethane, propane and other hydrocarbon gases and water vapor, carbon dioxide and nitrogen. The quantity of nitrogen in the natural gas can vary widely. Typical natural gases may contain anywhere from nearly zero percent up to 10 percent or more. It is desirable to remove the nitrogen from the natural gas during the liquefaction thereof to reduce the concentration of nitrogen in the liquid collected in the storage tank. Nitrogen in the liquid natural gas takes up volume and reduces the amount of methane and other combustible gases that can be stored. Moreover, nitrogen in the liquid natural gas reduces its temperature and increases the refrigeration required for liquefaction. Further, even small concentrations of nitrogen of on the order of 1% in the liquid natural gas can induce stratification of the liquid natural gas in a storage tank into distinct layers. The lower layer can store heat for a period of time and then quickly mix with the upper layer, releasing the heat by suddenly vaporizing a large quantity of natural gas. Thus, it is desirable to remove the nitrogen from the natural gas before it is stored rather than design the system to safely handle the periodic release of a large quantity of vaporized natural gas from the storage tank.

A natural gas liquefaction plant using a multicomponent refrigeration cycle typically has at least two compressors. The multicomponent refrigeration cycle requires a compressor to circulate the multicomponent cycle gas from low pressure to high pressure. A second compressor is required to compress boil off gas generated in the liquid natural gas storage tank due to heat leak into the tank. The compressor also compresses any flash gas generated when the liquid natural gas enters the tank. A compressor for the feed gas may also be used but frequently the natural gas feed is available from a pipeline at sufficient pressure to be liquefied.

Conventionally, small quantities of nitrogen have been removed from liquefied natural gas by allowing sufficient vaporization to occur as the nitrogen enters the storage tank so that most of the nitrogen leaves with the flash gas and the remaining liquid quantity contains only a small quantity of nitrogen. In order to remove larger quantities of nitrogen, however, the same has been removed by distillation during the liquefaction process.

A need continues to exist, therefore, for a method by which nitrogen can be removed from liquefied natural gas in an efficient manner requiring the use of low power.

SUMMARY OF THE INVENTION

Accordingly, it is an object of the present invention to provide a method of producing a methane-rich liquid stream from a stream of natural gas predominantly consisting of methane and nitrogen.

It is also an object of the present invention to provide such a method in an efficient and low energy intensive manner.

These objects and others, as will become apparent in view of the following, are provided by a method of producing a methane-rich liquefied natural gas from a stream of natural gas predominantly consisting of methane and nitrogen, the process entailing:

a) supplying the natural gas stream at a pressure above atmospheric pressure, b) cooling and liquefying the natural gas stream using at least one refrigeration cycle, and c) expanding the liquefied natural gas to lower pressure in at least two stages in series, phase separating the gas and liquid phases produced during the expansion, thereby concentrating the nitrogen into the vapor phases, and producing a methane-rich liquefied natural gas.

DETAILED DESCRIPTION OF THE PREFERRED EMBODIMENTS

Figure 1:
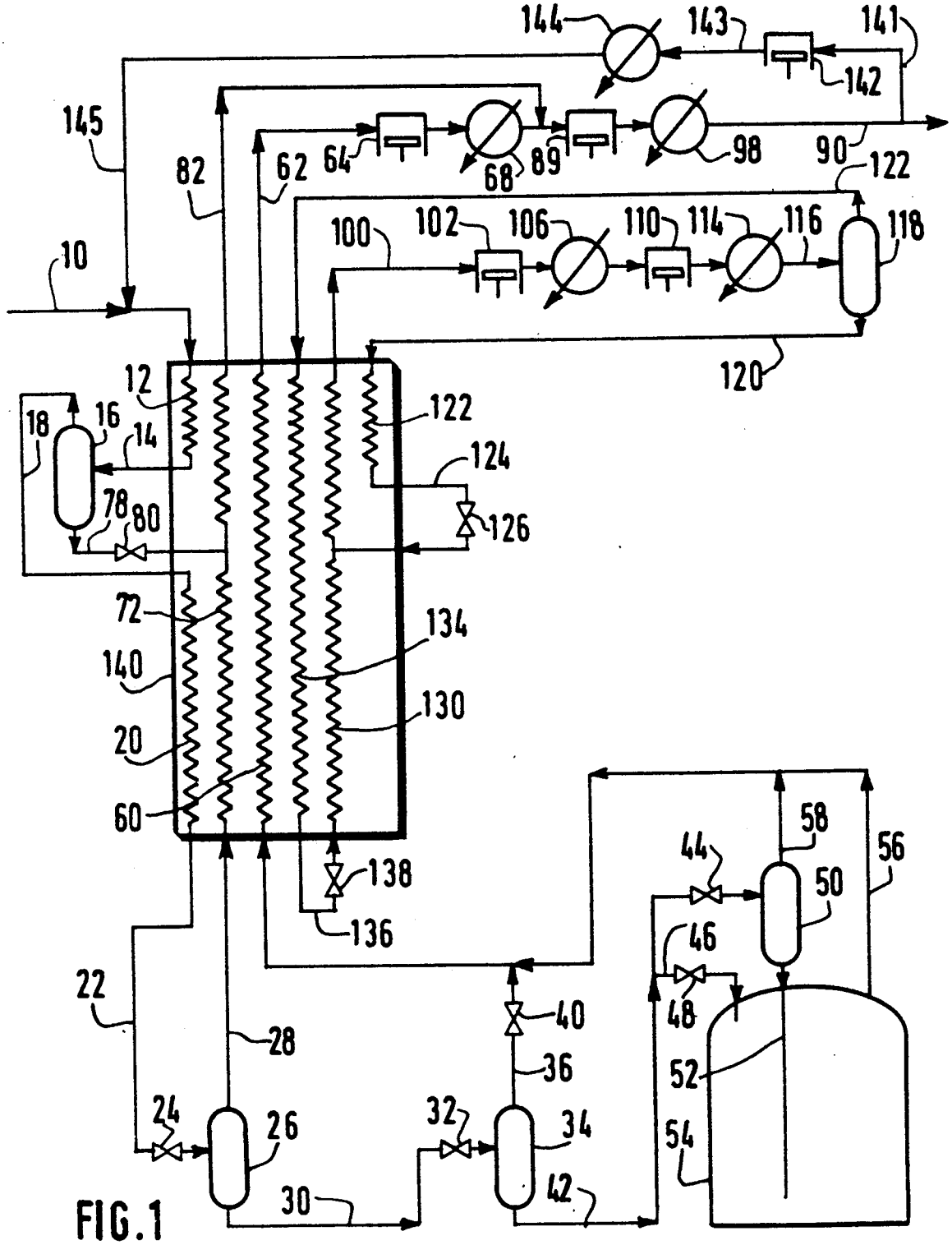
FIG. 1 is a schematic flow diagram of one preferred embodiment of the present invention.

In accordance with the present invention, a method is provided for producing a methane-rich liquefied natural gas in an efficient and low-energy intensive manner.

The present invention provides a method of producing a methane-rich liquefied natural gas from a stream of natural gas predominantly consisting of methane and nitrogen, which entails:

a) supplying the natural gas stream at a pressure above atmospheric pressure, b) cooling and liquefying the natural gas stream using at least one refrigeration cycle, and c) expanding the liquefied natural gas to lower pressure in at least two stages in series, phase separating the gas and liquid phases produced during the expansion, thereby concentrating the nitrogen into the vapor phases, and producing a methane-rich liquefied natural gas.

After producing the methane-rich liquefied natural gas in step c), the high nitrogen-containing vapor phases can then be heated to about ambient temperature for use as a fuel gas. The methane-rich liquefied natural gas is stored.

The present invention also provides a method of producing a methane-rich liquefied natural gas from a stream of natural gas predominantly consisting of methane and nitrogen, which entails:

a) supplying the natural gas stream at a pressure above atmospheric pressure, b) providing a multicomponent refrigeration fluid composed of a mixture of hydrocarbons with different boiling points, c) compressing the multicomponent refrigeration fluid to a pressure within the range of about 250 to 1,200 psig, d) cooling and partially condensing the multicomponent refrigeration fluid by passing it through a compressor aftercooler in heat exchange with a cooling fluid, e) separating the liquid and vapor phase produced in the compressor aftercooler in a phase separator, f) condensing and subcooling the vapor from the phase separator in a heat exchange apparatus, expanding the stream to low pressure and reheating and at least partially vaporizing it in heat exchange with itself and other streams in the heat exchange apparatus, g) subcooling the liquid from the phase separator in the heat exchange apparatus, expanding it to low pressure, combining it with liquefied, expanded and reheated vapor from the phase separator, h) vaporizing and reheating the combined stream in the heat exchange apparatus by heat exchange with itself and other streams passing through the heat exchange apparatus, i) returning the vaporized and reheated stream for recompression according to step (c), j) liquefying at least a major portion of the natural gas stream in the heat exchange apparatus, and k) expanding the liquefied natural gas stream to lower pressure in two or more stages in series, phase separating the gas and liquefied phases produced during the expansion, thereby reducing the concentration of nitrogen in the liquid phase and increasing the nitrogen concentration in the vapor phases, and thereby producing a methane-rich liquefied natural gas.

Additionally, the high nitrogen containing vapor phases may be heated to about ambient temperature in heat exchange apparatus so that the gas can be used as fuel.

The above processes for producing a methane-rich liquefied natural gas will now be described in more detail.

In the first exemplary process mentioned above, the natural gas stream is supplied at a pressure above atmospheric pressure. Typically, pressures in the range of about 150 to 1,200 psig are used. It is most preferred if pressures of about 300 to 650 psig are used.

Thereafter, the natural gas stream is cooled and liquefied using at least one refrigeration cycle. Typically, the stream is cooled to a temperature between about −100° C. to −150° C. The preferred temperature is determined by the amount of nitrogen to be removed from the natural gas.

Then, the liquefied natural gas is expanded to a lower pressure in two or more stages. Usually, the final lower pressure will be about 30 psig to 0 psig. It is preferred, however, that the final lower pressure be about 15 psig to 0 psig. It is most preferred, however, that the final lower pressure be about 5 psig to 1 psig.

In accordance with the present invention, it is possible to obtain very low concentrations of nitrogen in the final liquid phase. Notably, the composition of nitrogen in the final liquid phase should be less than 0.8 molar %. Concentrations of less than this are attainable using the present invention.

In the second exemplary process mentioned above, the natural gas stream is supplied at the same pressures as for the first exemplary process. That is, pressures in the range of about 150 to 1,200 psig are used, with about 200 to 900 psig, and 300 to 650 psig, being the preferred and most preferred ranges, respectively.

Then, a multicomponent refrigeration fluid is provided. This fluid, when recycled between the two pressures, must be capable of cooling, liquefying and subcooling the natural gas and rejecting, to an atmospheric stream such as air or water, the heat thus removed from the natural gas.

In the compression step, the multicomponent refrigeration fluid is compressed under a pressure of typically about 250 to 1,200 psig. Notably, pressures below and above this range may be required and used depending upon the gas composition and pressures and ambient temperature conditions. It is preferred, however, that a pressure of 300 to 600 psig be used.

Next, the multicomponent refrigeration fluid is cooled and partially condensed by passing it through a compressor aftercooler in heat exchange with a cooling fluid. Cooling fluids such as air or water may be used. The temperature to which the multicomponent refrigeration fluid is cooled is determined by ambient conditions. The liquid and vapor phases produced in the compressor aftercooler are separated in a phase separator.

Thereafter, the vapor from the phase separator is condensed and subcooled in a heat exchange apparatus. The pressure utilized for this step is essentially the same as the discharge pressure of the compressor less the pressure drop in the aftercooler. The temperature to which the high pressure gas is cooled is determined by the need to provide cooling to condense and subcool the natural gas stream.

The subcooled stream is expanded to low pressure and reheated and at least partially vaporized in heat exchange with itself and other streams in the heat exchange apparatus.

After expansion, the refrigeration cycle fluid must be at a lower temperature than the temperature to which the natural gas is cooled.

The low pressure is typically in the range of 10 to 100 psig, however, it is preferably in the range of about 30 to 70 psig.

Thereafter, the liquid from the phase separator is subcooled in the heat exchange apparatus and is expanded to low pressure and combined with liquefied, expanded and reheated vapor from the phase separator. Notably, the fluid is subcooled to such a temperature that the temperature drop across the expansion valve is between about 3° to 10° F.

Then, after a vaporizing and reheating step for the combined stream in the heat exchange apparatus, it is returned to the compressor for recompression.

The refrigeration produced by the above described refrigeration cycle is used to liquify the natural gas. The natural gas, at the pressure previously specified, is sent to the heat exchange apparatus where it is cooled and at least a major portion of it is liquefied. Typically the stream is cooled to a temperature between about −100° C. to 150° C. The preferred temperature is determined by the amount of nitrogen to be removed from the natural gas.

Finally, it is noted that the liquefied natural gas stream is expanded in two or more stages to a final lower pressure of about 30 psig to 0 psig. It is preferred that a final lower pressure of about 15 psig to 0 psig be used. It is most preferred, however, if a final lower pressure of about 5 psig to 1 psig is used.

As with the first exemplary process, the composition of nitrogen in the final liquid phase should be less than 0.8 molar %. Concentrations of less than this are attainable using the present invention.

In accordance with the present invention, it is preferred that the last stage of expansion of the liquid natural gas occurs in a liquid natural gas storage tank maintained slightly above atmospheric pressure. By the term "slightly above atmospheric pressure" is meant about 0.1 to 5 psi above atmospheric pressure. It is preferred, however, to use a excess pressure of about 0.5 to 2 psi above atmospheric pressure.

Further, it is preferred that the second to the last stage of expansion of the present invention occurs at a pressure controlled just sufficiently high enough to be able to send the liquid collected in this phase separator to the storage tank. This means, in practice, a pressure just sufficient to overcome the frictional pressure drop and the hydrostatic head of the pipeline connecting the separator and the storage tank.

The present invention also includes the possibility of the recompression of some of the expansion gases to the pressure of the natural gas and recycling this gas into the natural gas being liquefied.

Referring to FIG. 1, the natural gas feed enters the system through line 10 after being dried and freed of carbon dioxide. The feed gas is at a pressure above atmospheric pressure and in the temperature range of about 35° F. to 110° F.

The feed stream passes through passage 12 of heat exchange apparatus 140 where it is cooled to about −80° F., and leaves the heat exchange apparatus 140 through line 14, entering phase separator 16. The heavy hydrocarbons, which condense in passage 12, collect in the bottom of phase separator 16 and are removed through line 18, and expanded through valve 80 into passage 72 of the heat exchanger apparatus 140.

Uncondensed natural gas leaves phase separator 16 through line 18, entering passage 20 of heat exchange apparatus 140 where it is cooled and liquefied. The cooled natural gas leaves heat exchange apparatus 140 by way of line 22 and is expanded to lower pressure into phase separator 26. The gas phase which collects in phase separator 26 is high in nitrogen content relative to the nitrogen content of the natural gas feed. This vapor is removed from phase separator 26, by way of line 28 and is heated in passage 72 of heat exchange apparatus 140 to ambient temperature. Liquid from phase separator 16 also enters passage 72 at a suitable position in heat exchange apparatus 140 as previously described and is vaporized and heated also to ambient temperature. The total stream heated in passage 72 leaves heat exchange apparatus 140 by way of line 82.

The liquid natural gas which collects in phase separator 26 is low in nitrogen content relative to the nitrogen content of the natural gas feed. It leaves phase separator 26 by line 30 and is expanded by valve 32 into phase separator 34. Again nitrogen concentrates in the vapor phase making the liquid phase low in nitrogen content. Vapor leaves phase separator 34 through line 36 and is expanded by valve 40 into line 56. Liquid leaves phase separator 34 through line 42 and is expanded either by valve 48 directly into the top of the liquid natural gas (LNG) storage tank 54 or by valve 44 into phase separator 50. The liquid which collects in phase separator 50 drains by line 52 directly into the bottom of the liquid natural gas storage tank 54. Valve 44 is used if it is desired to send the liquefied natural gas to the bottom of the storage tank 54 and valve 48 is used if it is desired to send liquefied natural gas to the top of LNG storage tank. In either case the liquid phase is depleted in nitrogen and the vapor phase has a relatively high nitrogen content. The vapor phase either combines with the boil off gas generated by heat leak into storage tank 54 and leaves the tank through line 56 or leaves phase separator 50 through line 58 and joins the boil off gas leaving the storage tank through line 56.

The gas in line 56 is sent to passage 60 in heat exchange apparatus 140 and is warmed to ambient temperature, leaving heat exchange apparatus 140 through line 62. It is compressed in a compressor having a first stage 64, a second stage 84, an intercooler 68, and an aftercooler 88. The gas leaves intercooler 68 and is compressed, together with the gas in line 82, in the second stage 84 of the compressor. The combined stream leaves the aftercooler through line 90. It can be used as fuel gas either inside or outside the plant.

The refrigeration required to liquefy the natural gas is provided by a multicomponent refrigeration system. Many fluids can be used to make up the refrigerant fluid but it has been discovered that high efficiency is obtained with a fluid containing methane, ethylene, propane, butane and pentane. Among other components that may be used to make up the fluid are nitrogen, ethane and propylene. Isopentane is preferred to normal pentane because of its low freezing point.

Referring again to FIG. 1, the refrigerant fluid is compressed by a compressor consisting of two stages 102 and 110 plus intercooler 106 and aftercooler 114. About 25 mol percent of the fluid condenses in the aftercooler. The refrigerant passes through line 116 to phase separator 118 where the liquid and gas phases separate. Liquid leaves phase separator 118 through line 120 and is cooled passing through coil 122 in heat exchange apparatus 140. It leaves heat exchange apparatus 140, through line 124 and is expanded in valve 126 to low pressure. It enters coil 130 at an intermediate position in heat exchange apparatus 140.

Gas leaves phase separator 118 through line 132, entering coil 134 in heat exchange apparatus 140, where it is cooled and condensed. It leaves heat exchange apparatus 140 through line 136 and is expanded to low pressure through valve 138, returning to coil 130 in heat exchange apparatus 140. Both liquids entering coil 130 are vaporized and heated to ambient temperature in coil 130. They leave heat exchange apparatus 140 through line 100 and are returned to the compressor as previously described.

Heat exchange apparatus 140 represents one or more heat exchangers which can be arranged in many configurations of exchangers in parallel and series depending on the size of the plant an the type of exchanger employed. The invention is not limited to any type of exchanger but because of economics, brazed aluminum plate and fin exchangers and coil wound shell and tube exchangers are preferred. In accordance with the present invention, however, it is essential for all streams containing both liquid and vapor phases that are sent to the heat exchanger apparatus that both liquid and vapor phases are equally distributed across the cross section area of the passage they enter. To accomplish this, it is preferred to provide distribution apparati for the individual vapor and liquid streams. Separators can be added to the flow sheet as required to divide streams into separate liquid and vapor streams. Such separators could be added downstream of valves 80, 126 and 138.

FIG. 1 illustrates separator 50 mounted outside liquid natural gas storage tank 54. Alternatively, this separator can also be mounted in the vapor space at the top of the tank in which case, the separator would be open at the top and line 58 is eliminated.

FIG. 1 also illustrates three separators operating at three pressure pressure levels that are used to remove nitrogen from the liquid natural gas and to cool it to the storage tank temperature. In accordance with the present invention, however, it is possible to use more or fewer separators depending on the requirements for nitrogen removal and for optimizing the efficiency of the cycle. In addition, other arrangements can be made for compressing the gas produced in the natural gas separators. For example, it is not necessary to combine all the streams from the natural gas separators into a single stream. Instead, the highest pressure stream can be used as plant fuel while the lower pressure streams are delivered for off-site sale. In addition, it is possible to selectively compress one or more of the liquid natural gas separator streams for recycle back to the feed gas or for liquefaction in a separate passage of the heat exchange apparatus.

Thus, the present invention provides a process for removing nitrogen from natural gas during liquefaction. The present invention is extremely advantageous in that less flash gas is produced in the flash drums when a natural gas containing nitrogen is expanded than when a natural gas containing no nitrogen is expanded.

When liquefying a natural gas containing a low concentration of nitrogen, it is possible to obtain the low power benefit of this cycle by compressing some of the nitrogen containing flash gas into the feed gas to raise the nitrogen content of the feed gas. This is illustrated in FIG. 1. A stream of high nitrogen content gas is taken from line 90 through line 141 to compressor 142. Compressor 142 raises the pressure of the gas to feed gas pressure and it is sent by line 143 to aftercooler 144 and then by line 145 into natural gas feed in line 10.

Having described the present invention, it will now be apparent to one skilled in the art that numerous modifications and variations of the present invention are possible in light of the above teachings. It is therefore to be understood that within the scope of the appended claims, the invention may be practiced otherwise than as specifically described herein.

What is new and desired to be secured by letters patent of the U.S. is:

1. A method of producing a methane-rich liquid stream from a stream of natural gas predominantly consisting of methane and also containing nitrogen, comprising:

(a) supplying said natural gas stream at a pressure above atmospheric pressure, (b) cooling and liquefying said natural gas stream using one or more refrigeration cycles, (c) expanding said liquefied natural gas to lower pressure in two or more stages in series, phase separating the gas and liquid phases produced during the expansion, thereby concentrating the nitrogen into the gas phases and producing a methane-rich and nitrogen depleted liquefied natural gas, and (d) reheating the gas phases enriched in nitrogen, and sending them out of the plant as nitrogen-enriched product streams.

2. The method as a claimed in claim 1, in which the last stage of expansion of the liquid natural gas takes place in a liquid natural gas storage tank maintained slightly above atmospheric pressure.

3. The method as claimed in claim 2, in which the second to the last stage of expansion takes place at a pressure controlled just sufficiently high enough to be able to send the liquid collected in this phase separator to the storage tank.

4. The method as claimed in claim 1, which further comprises a step of recompressing some of the expansion gases to the pressure of the natural gas and recycling this gas into the natural gas being liquefied.

5. The method as claimed in claim 1, wherein said natural gas stream in step a) is supplied at a pressure of about 150 to 1,200 psig.

6. The method as claimed in claim 1, wherein said natural gas stream in step (b) is cooled and liquefied to a temperature between about −100° C. to −150° C.

7. The method as claimed in claim 1, wherein said liquefied natural gas in step (c) is expanded to a final lower pressure of about 30 psig to 0 psig.

8. The method as claimed in claim 1, wherein said methane-rich liquefied natural gas has less than 0.8 molar % of nitrogen in the final liquid phase.

9. The method as claimed in claim 1, which further comprises recovering said nitrogen-enriched product streams.

10. The method as claimed in claim 1, wherein further comprises using said nitrogen-enriched product streams as fuel gas.

11. A method of producing a methane-rich liquid stream from a stream of natural gas predominantly consisting of methane and also containing nitrogen, comprising:

(a) supplying said natural gas stream at a pressure above atmospheric pressure, (b) providing a multicomponent refrigeration fluid composed of a mixture of components each having different boiling points, (c) compressing said multicomponent refrigeration fluid to a pressure within the range of about 250 to 1,200 psig, (d) cooling and partially condensing said multicomponent refrigeration fluid by passing it through a compressor aftercooler in heat exchange with a cooling fluid, (e) separating the liquid and vapor phases produced in the compressor aftercooler in a phase separator, (f) condensing and subcooling the vapor from the phase separator in a heat exchange apparatus, expanding the stream to low pressure and vaporizing and reheating it in heat exchange with itself and other streams in the heat exchange apparatus, (g) subcooling the liquid from the phase separator in the heat exchange apparatus, expanding it to low pressure, combining it with liquefied, expanded and reheated vapor from the phase separator, (h) vaporizing and reheating the combined stream in the heat exchange apparatus by heat exchange with itself and other streams passing through the heat exchange apparatus, (i) returning the vaporized and reheated stream for recompression according to step (c), (j) liquefying at least the major portion of the natural gas stream in the heat exchange apparatus, (k) expanding said liquefied natural gas to lower pressure in two or more stages in series, phase separating the gas and liquid phases produced during expansion, thereby concentrating the nitrogen into the gas phases and producing a methane-rich and nitrogen depleted liquefied natural gas, and (l) reheating the gas phases enriched in nitrogen, and sending them out of the plant as nitrogen-enriched product streams.

12. The method as claimed in claim 11, in which the last stage of expansion of the liquid natural gas takes place in a liquid natural gas storage tank maintained slightly above atmospheric pressure.

13. The method as claimed in claim 12, in which the second to the last stage of expansion takes place at a pressure controlled just sufficiently high enough to be able to send the liquid collected in this phase separator to the storage tank.

14. The method as claimed in claim 11, which further comprises a step of recompressing some of the expansion gases to the pressure of the natural gas and recycling this gas into the natural gas being liquefied.

15. The method as claimed in claim 11, wherein said natural gas stream in step a) is supplied at a pressure of about 150 to 1,200 psig.

16. The method as claimed in claim 11, wherein said multicomponent refrigeration fluid is such that, when recycled between the two pressures, it is capable of cooling, liquefying and subcooling the natural gas and rejecting heat thus removed from the natural gas.

17. The method as claimed in claim 11, wherein said compression in step (c) is effected to a pressure of about 300 to 600 psia.

18. The method as claimed in claim 11, wherein said cooling fluid in step (d) is air or water.

19. The method as claimed in claim 11, wherein said stream expansion of step (f) is effected to a pressure of about 250 to 1,200 psig.

20. The method as claimed in claim 11, wherein said liquefied natural gas in step k) is expanded to a final lower pressure of about 30 to 0 psig.

21. The method as claimed in claim 11, wherein said multicomponent refrigeration fluid comprises nitrogen methane, ethylene, propane, butane and isopentane.

22. The method as claimed in claim 11, which further comprises recovering said nitrogen-enriched product streams.

23. The method as claimed in claim 11, wherein said natural gas stream in step a) is supplied at a pressure of about 50 to 1,200 psig.

24. The method as claimed in claim 11, wherein said natural gas stream in step (j) is cooled and liquified to a temperature between −100° C. to −150° C.

25. The method as claimed in claim 11, which further comprises using said nitrogen-enriched product streams as fuel gas.

* * * * *